US005731795A

United States Patent [19]

Kanda et al.

[11] Patent Number: 5,731,795

[45] Date of Patent: Mar. 24, 1998

[54] MATRIX DISPLAY DEVICE HAVING LOW POWER CONSUMPTION CHARACTERISTICS

[75] Inventors: Shoji Kanda, Nagoya; Masaaki Ozaki, Kariya, both of Japan

[73] Assignee: Denso Corporation, Kariya, Japan

[21] Appl. No.: 764,766

[22] Filed: Dec. 12, 1996

[51] Int. Cl.[6] ..... G09G 3/36

[52] U.S. Cl. ..... 348/94; 345/98

[58] Field of Search ..... 345/87, 90, 94, 345/96, 95, 98, 99, 100; 348/790, 792, 793; 349/33, 34, 36

[56] References Cited

U.S. PATENT DOCUMENTS

| | | | |
|---|---|---|---|
| 5,424,753 | 6/1995 | Kitagawa et al. | 345/94 |
| 5,583,533 | 12/1996 | Moriyama | 345/94 |
| 5,617,111 | 4/1997 | Saitoh | 345/100 |
| 5,631,752 | 5/1997 | Tanaka | 349/173 |

FOREIGN PATENT DOCUMENTS

| | | |
|---|---|---|
| 54-15618 | 2/1979 | Japan . |
| 4-223369 | 8/1992 | Japan . |
| 5-119746 | 5/1993 | Japan . |
| 5-152917 | 6/1993 | Japan . |
| 7-64056 | 3/1995 | Japan . |

*Primary Examiner*—Dennis-Doon Chow

*Attorney, Agent, or Firm*—Cushman Darby & Cushman IP Group of Pillsbury Madison & Sutro LLP

[57] ABSTRACT

An analog sampling circuit of a signal electrode driver of a matrix type liquid crystal device includes two pairs of FETs. During a first half of a select period of a scanning electrode, a first pair of serially connected FETs are deactuated while actuating one FET of the second pair of FETs to provide a signal voltage to a signal electrode of the display device. On the other hand, during the latter half of the select period, the first pair of FETs are actuated to provide an image signal voltage to the signal electrode.

15 Claims, 15 Drawing Sheets

| | | | | | | | | |
|---|---|---|---|---|---|---|---|---|
| Y1 | -M | E | +S | +M | E | -S | -M | |
| Y2 | +M | E | -S | -M | E | +S | +M | |
| Y3 | -M | E | +S | +M | E | -S | -M | |

VEE2
Xi VCOM
VSS2
IMAGE DATA
L1 NL1
L2 NL2
L3 NL3
L4 NL4
L5 NL5

STD

ECG

PCG

33b

33c

34
OU
L1
L3
L5

39N2
OUT

39P2

35
NL2
NL4

STD

HCK1

HCK2

HCK3
SAMPLING TIMING
X1
X2
X3
X4
X5
X6
Xm-3
Xm-2
Xm-1
Xm

MATRIX DISPLAY DEVICE HAVING LOW POWER CONSUMPTION CHARACTERISTICS

CROSS-REFERENCE TO RELATED APPLICATION

This application is related to and claims priority from Japanese Patent Application No. Hei-7-324,809, the contents of which are hereby incorporated by reference.

BACKGROUND OF THE INVENTION

1. Field of the Invention

The present invention relates to a matrix type display device which uses an anti-ferroelectric smectic liquid crystal medium or the like.

2. Description of Related Art

Japanese Patent Laid Open Publication No. Hei-5-119746 discloses one conventional well-known matrix type liquid crystal display device. As shown in FIG. 12, this display device includes a liquid crystal panel 1 wherein a plurality of scanning electrodes Y1–Yn and a plurality of signal electrodes X1–Xm are formed to intersect with each other. Pixels are provided at intersections of the scanning electrodes Y1–Yn and signal electrodes X1–Xm. Each pixel lightens or darkens depending on a voltage difference between the scanning electrode and the signal electrode it is connected to. A scanning electrode driver 2 applies a scanning voltage to each of the scanning electrodes Y1–Yn. This scanning voltage applied to a scanning electrode is one of an erase voltage for darkening the pixels (i.e., reducing the light transmissivity of the pixels) connected to the scanning electrode, a select voltage for lightening the same pixels (i.e., increasing the light transmissivity of the pixels) to display an image and a maintain voltage for maintaining the state of these pixels. A scanning electrode is said to be in a select period when the select voltage is being applied to it by the scanning electrode driver 2. In the same way, a scanning electrode is in an erase period when the scanning electrode driver 2 is applying the erase voltage to it and in a maintain period when the scanning electrode driver 2 is applying the maintain voltage to it. In synchronization with the application of the select voltage by the scanning electrode driver 2 to a scanning electrode, a signal electrode driver 2 applies a signal voltage corresponding to image data to the signal electrodes X1–Xm to display an image in the pixels along the scanning electrode.

The matrix type liquid crystal display device displays images by the repeated execution of the steps of displaying image data in the pixels along the selected scanning electrode during the select period and maintaining the image displayed in the pixels during the maintain period. The anti-ferroelectric liquid crystals of the matrix type liquid crystal display device are driven by applying a first voltage to the scanning electrodes Y1–Yn during a first half of the select period and a second voltage to the scanning electrodes Y1–Yn during the latter half of the select period whereby the first and second voltages have the same magnitudes but have opposite polarities.

As shown in FIGS. 13A–13B, the scanning electrode driver 2 generates the scanning voltages of the scanning electrodes Y1–Yn based on a plurality of voltages provided by a driving voltage generator 4 and a plurality of control signals provided by a controller 5.

Also, the signal electrode driver 3 receives a DAP signal (i.e., image data signal) and voltages generated by a driving voltage generator 7 and thereafter provides the signal electrodes X1–Xm with image signal voltages, which are shown in FIG. 13C, based on control signals from the controller 5. Here, both the scanning electrode driver 2 and the signal electrode driver 3 receive power from a common power source circuit 6.

Meanwhile, as shown in FIG. 14, the signal electrode driver 3 includes an m-bit shift register **3*a*, m analog sampling circuits 3*b* and m output buffers 3*c*. FIG. 15 shows an actual construction of each analog sampling circuit 13*b*. As shown in FIG. 15, each analog sampling circuit 3*b* includes a plurality of sample-and-hold circuits 8*a*–8*d*. The respective voltages of these sample-and-hold circuits 8*a*–8*d* are selectively generated as Vout via FETs 8*h* and 8*i* by manipulating analog switches 8*e*–8*g***.

Output voltage Vout from the pair of FETs **8*h* and 8*i* depends on the on-resistivity of these FETs 8*h* and 8*i*. In this way, both of these FETs 8*h* and 8*i* are in operation during all select periods of all the scanning electrodes Y1–Yn of the liquid crystal panel 1. That is, current will be passing through both FETs 8 and 8*i* during the entire select period for the scanning electrodes Y1–Yn. Taking into account that this occurs simultaneously for all the analog sampling circuits 3*b*, power consumption of the signal electrode driver 3** becomes significantly large which goes against the demands for lessening the power consumption of the liquid crystal display device.

SUMMARY OF THE INVENTION

In this light, the inventors of the present invention have investigated ways of reducing the power consumption of a liquid crystal display device by finding ways to reduce the amount of current flowing through FETs of analog sampling circuits during the select period. According to the results of their investigation, light transmissivity needed for maintaining display data, which is set in the select period, during the maintain period primarily depends on the magnitude of the image signal voltage applied to signal electrodes during the latter half of the select period.

Therefore, the analog sampling circuits must be constructed such that they generate voltage that is at least sufficient enough for maintaining the brightness (i.e., light transmissivity) of the liquid crystal panel without making current pass through a pair of its FETs during the first half of the select period and generate image signal voltage during the latter half of the select period. In this way, power consumption of the display device can be reduced.

Accordingly, one object of the present invention is to provide a matrix display device which can effectively maintain brightness (i.e., light transmissivity) of its display panel while keeping its power consumption at a minimum.

To achieve the above-mentioned object, one aspect of the present invention provides a matrix type liquid crystal display device which has a liquid crystal panel, a scanning electrode driving unit and a signal electrode driving unit. The liquid crystal panel has a plurality of scanning electrodes, a plurality of signal electrodes and a liquid crystal layer. The plurality of scanning electrodes and the plurality of signal electrodes cooperate with the liquid crystal layer to form a plurality of pixels for displaying an image. The scanning electrode driving unit is for sequentially scanning the plurality of scanning electrodes of the liquid crystal panel by applying a select voltage to each scanning electrode of the plurality of scanning electrodes during a select period for lightening pixels along each respective scanning electrode. The signal electrode driving unit is for applying a signal voltage to the plurality of signal electrodes of the liquid crystal panel. The signal electrode driving unit includes a predetermined voltage generator, an image signal generator and a setting unit. The predetermined voltage generator is for generating a predetermined voltage. The image signal generator is for generating a display voltage in accordance with the image to be displayed in the liquid crystal panel. The setting unit sets the predetermined voltage as the signal voltage during a first half of the select period, sets the display voltage as the signal voltage during a latter half of the select period and deactuates the image signal generator during the first half of the select period.

In this way, because the display voltage is generated only during the latter half of the select period, power consumption of the matrix type liquid crystal device can be reduced significantly.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF PRESENTLY PREFERRED EXEMPLARY EMBODIMENTS

Preferred embodiments of the present invention are described hereinafter with reference to the accompanying drawings.

Figure 1:
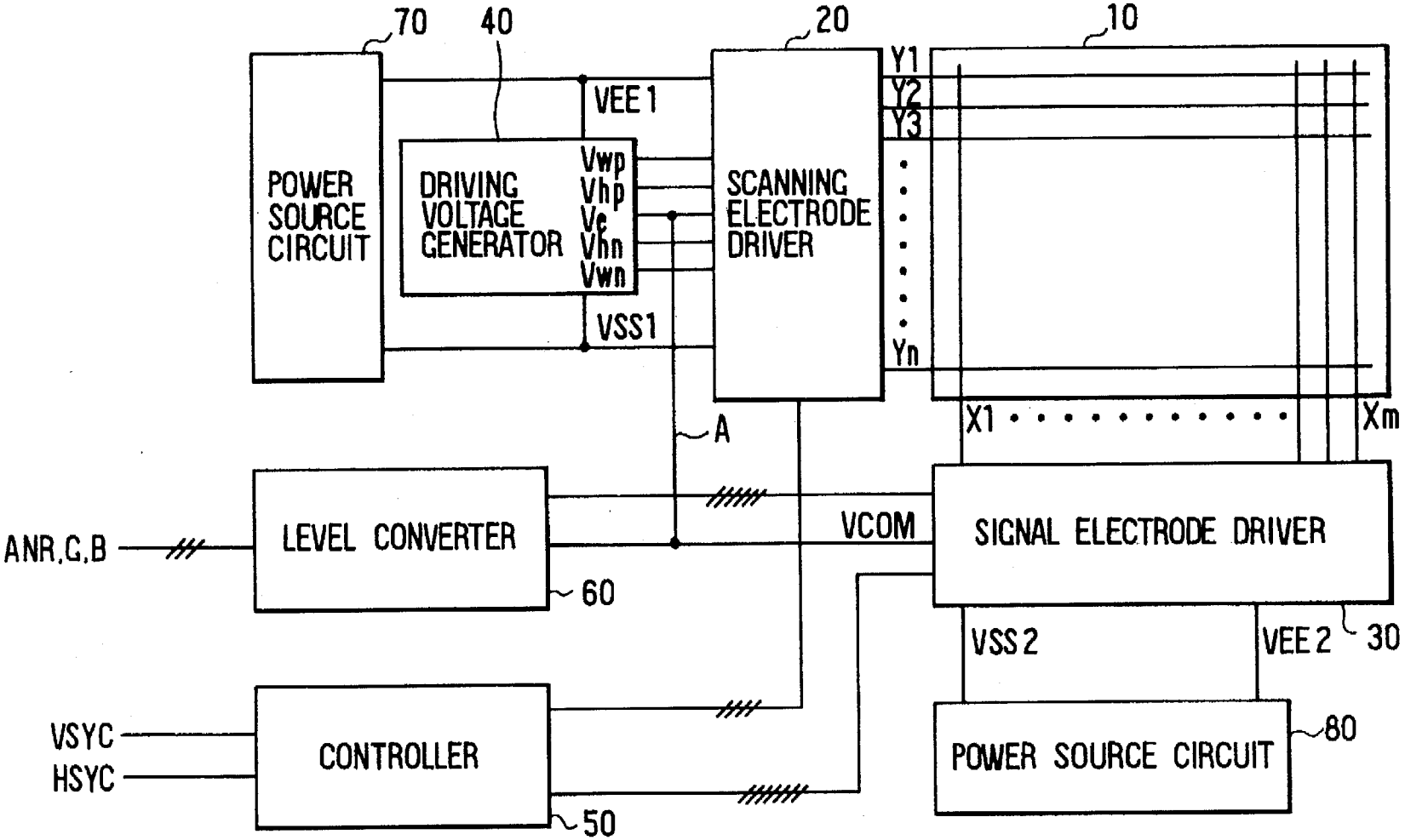
FIG. 1 is a block diagram of a liquid crystal device according to a first embodiment of the present invention.

A first embodiment of the present invention is described hereinafter with reference to FIGS. 1–10. FIG. 1 shows an overall construction of a matrix-type liquid crystal display device of the present invention. This display device includes a liquid crystal panel 10 which encloses an anti-ferroelectric liquid crystal medium. The liquid crystal panel 10 includes n×m pixels that are formed by the anti-ferroelectric liquid crystal medium together with n lines of scanning electrodes Y1–Yn and m lines of signal electrodes X1–Xm that intersect with each other.

Figure 2:
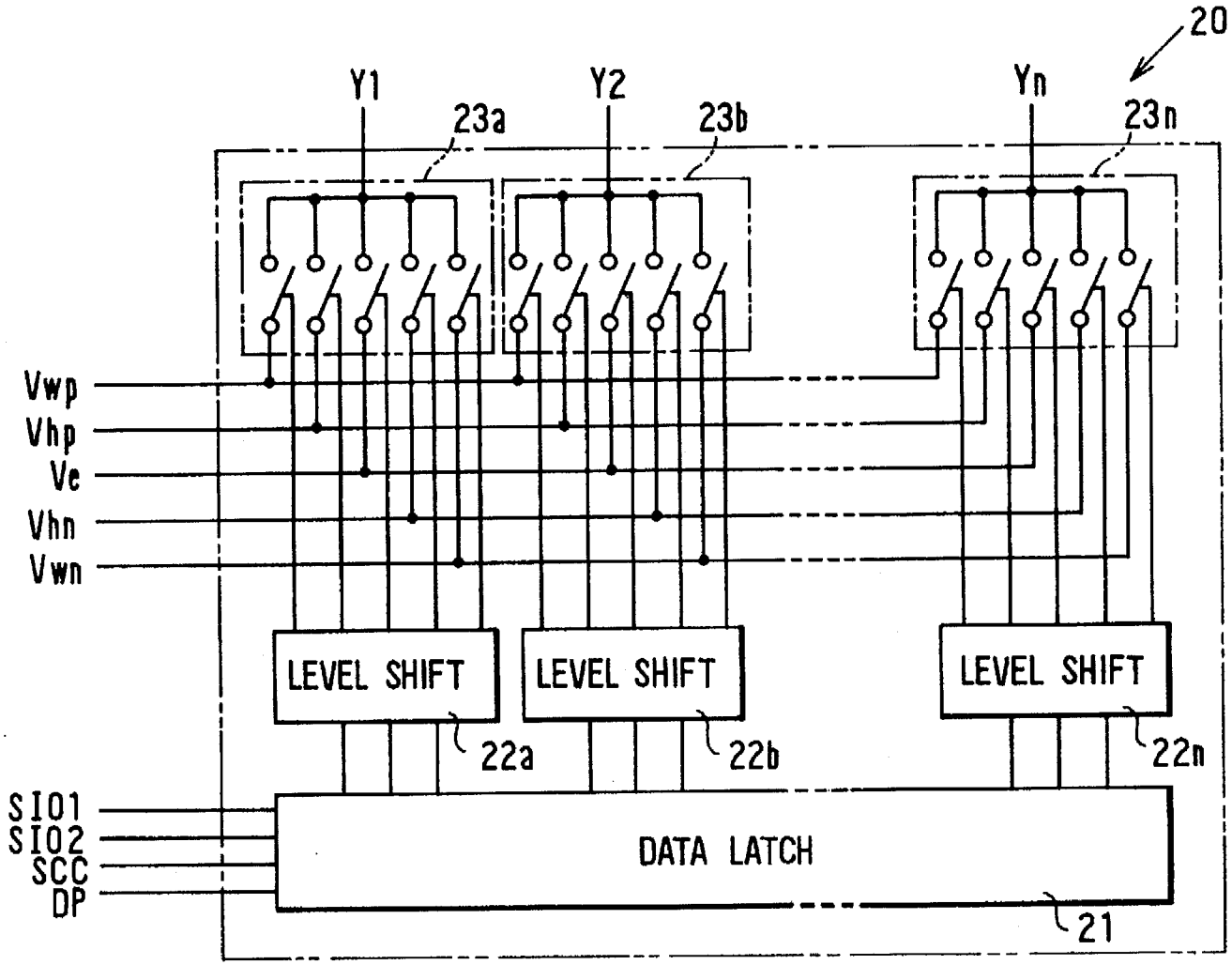
FIG. 2 is a block diagram of a scanning electrode driver of the liquid crystal display device.

A scanning electrode driver 20 performs linear sequential scanning on the scanning electrodes Y1–Yn of the liquid crystal panel 10 by sequentially applying a scanning voltage to these scanning electrodes Y1–Yn. The scanning voltage is one of a select voltage, an erase voltage and a maintain voltage. FIG. 2 shows an actual construction of the scanning electrode driver 20 while FIGS. 3A–3G show the time chart of an operation of the scanning electrode driver 20.

The scanning electrode driver 20 includes a 3×n bit data latch 21, n level shift circuits **22*a*–22*n* and n analog switching circuits 23*a*–23*n*. Each switching circuit 23*a*–23*n*** includes five analog switches.

As shown in FIGS. 3A–3G, the scanning electrode driver 20 sequentially applies a scanning voltage to the scanning electrodes Y1–Y3. The scanning voltage corresponds to a voltage for erasing (i.e., the erase voltage), maintaining (i.e., the maintain voltage) or setting (i.e., the select voltage) the display content of a pixel. Because the liquid crystal display device is driven by an alternating current power source, the scanning electrode driver 20 inverts the polarity of the scanning voltage applied to the scanning electrodes Y1–Yn for each select period.

The operation of the scanning electrode driver 20 is explained hereinafter based on the operation of the scanning electrode Y1. During an erase period (E), the scanning electrode driver 20 provides an erase voltage Ve to the scanning electrode Y1. During a positive select period (+S), the scanning electrode driver 20 generates a negative select voltage Vwn followed by a positive select voltage Vwp. During a positive maintain period (+M), the scanning electrode driver 20 provides a positive maintain voltage vhp to the scanning electrode Y1 to maintain the display contents of the pixels.

The voltage applied to the scanning electrodes Y1–Yn in the next select period must have a polarity that is opposite that of the select voltage applied during the previous select period to drive the anti-ferroelectric liquid crystals. In this way, the positive select voltage Vwp followed by the negative select voltage Vwn is applied to the scanning electrode Y1. In the negative maintain period (–M), a maintain voltage Vhn is applied to the scanning electrode Y1 to maintain the display contents of the pixels connected to it. In this way, the polarities of the select voltage and the maintain voltage are inverted every time before they are applied to the scanning electrodes Y1–Yn.

Figure 3A:
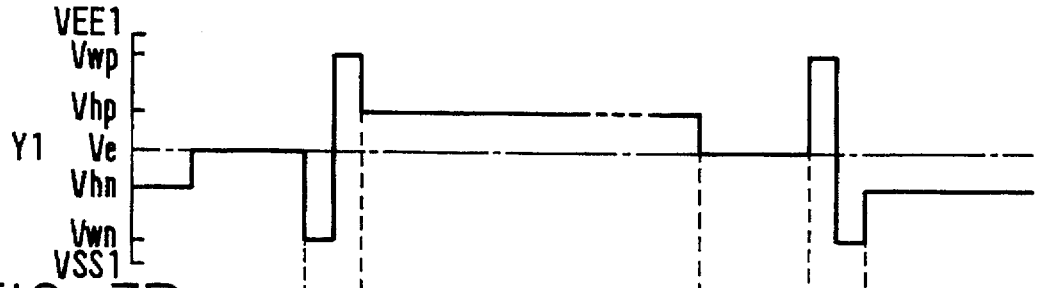
FIGS. 3A–3G are time charts showing an operation of the scanning electrode driver.
Figure 3B:
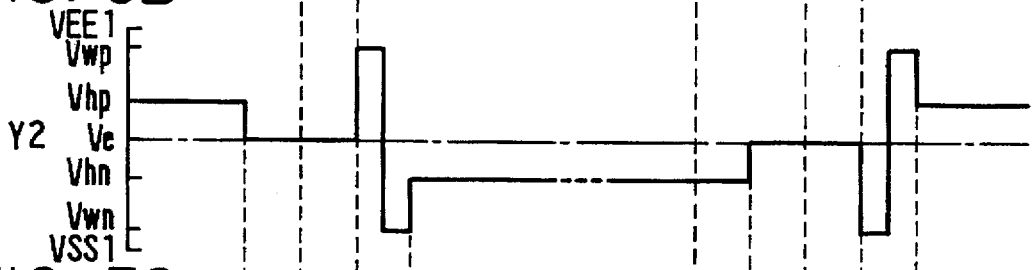
Figure 3C:
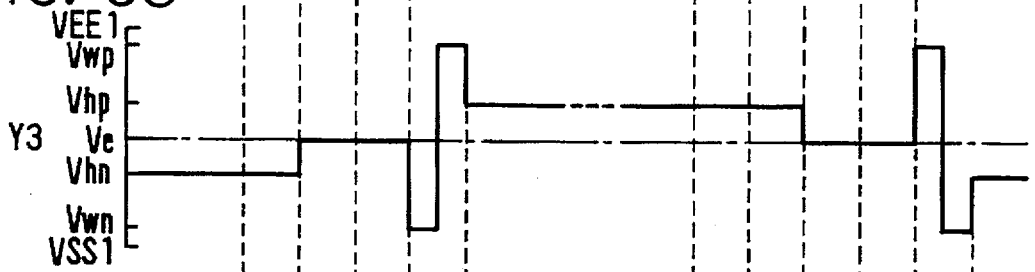
Figure 3D:
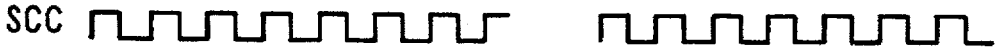
Figure 3E:
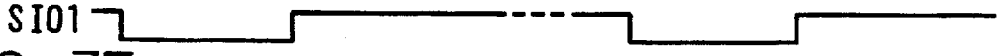
Figure 3F:
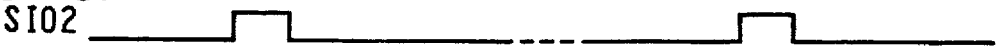
Figure 3G:
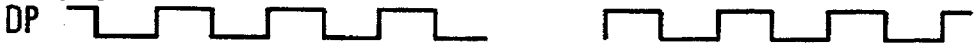

As shown in FIGS. 3A–3C, to perform successive scanning of the scanning electrodes Y1–Yn, the voltage waveform of the scanning voltage is delayed by, for example, one select period before application to a succeeding scanning electrode. In addition, to prevent flickering in the display panel 10, the polarity of the scanning voltage waveform applied to a succeeding scanning electrode is inverted so that, for example, a positive voltage is applied to scanning electrode Y1, a negative voltage is applied to scanning electrode Y2, a positive voltage is applied to scanning electrode Y3 and so on.

To perform the above-described operation, as shown in FIG. 2, SIO1, SIO2, SCC (scan clock) and DP (data polarity) signals are provided to the data latch 21 by a controller 50. The waveforms of these signals are shown in FIGS. 3D–3G.

Signals SIO1 and SIO2 set the state of the scanning electrodes Y1–Yn. That is, the scanning electrodes Y1–Yn are set to an erase state when signals SIO1 and SIO2 are both low, to a select state when signal SIO1 is low and signal SIO2 is high and to a maintain state when signal SIO1 is high and SIO2 is low. These signals are incorporated by the data latch 21 at each rising edge of the SCC signal.

Moreover, the signal DP determines the polarity of the scanning voltage to be applied to the scanning electrodes Y1–Yn. That is, the polarity of the DP signal during the select period of each of the scanning electrodes Y1–Yn determines the polarity of the scanning voltage. For example, if the DP signal changes from high to low during the positive select period, the scanning voltage is switched from Vwn to Vwp. 0n the other hand, if the DP signal changes from low to high during the negative select period, the scanning voltage is switched from Vwp to Vwn. In this way, the DP signal directly determines the polarity of the scanning voltage during the select period. The polarity of the scanning voltage during the maintain period is the same as the polarity determined by the DP signal during the previous select period.

Accordingly, the 3×n bit data latch 21 of the scanning electrode driver 20 takes in three bits of data, i.e., SIO1, SIO2 and DP signals, from the controller 50 at the rising edge of the SCC signal and controls the scanning electrodes Y1–Yn based on these signals.

The level shift circuits **22*a*–22*n* convert the output data from the data latch 21 to control the five analog switches of each analog switch circuit 23*a*–23*n*. Therefore, the scanning voltages shown in FIGS. 3A–3C are generated based on the five levels of voltages (namely, Vwp, Vhp, Ve, Vhn and Vwn) generated by a driving voltage generator 40** and these scanning voltages are then provided to the scanning electrodes Y1–Yn.

Figure 4:
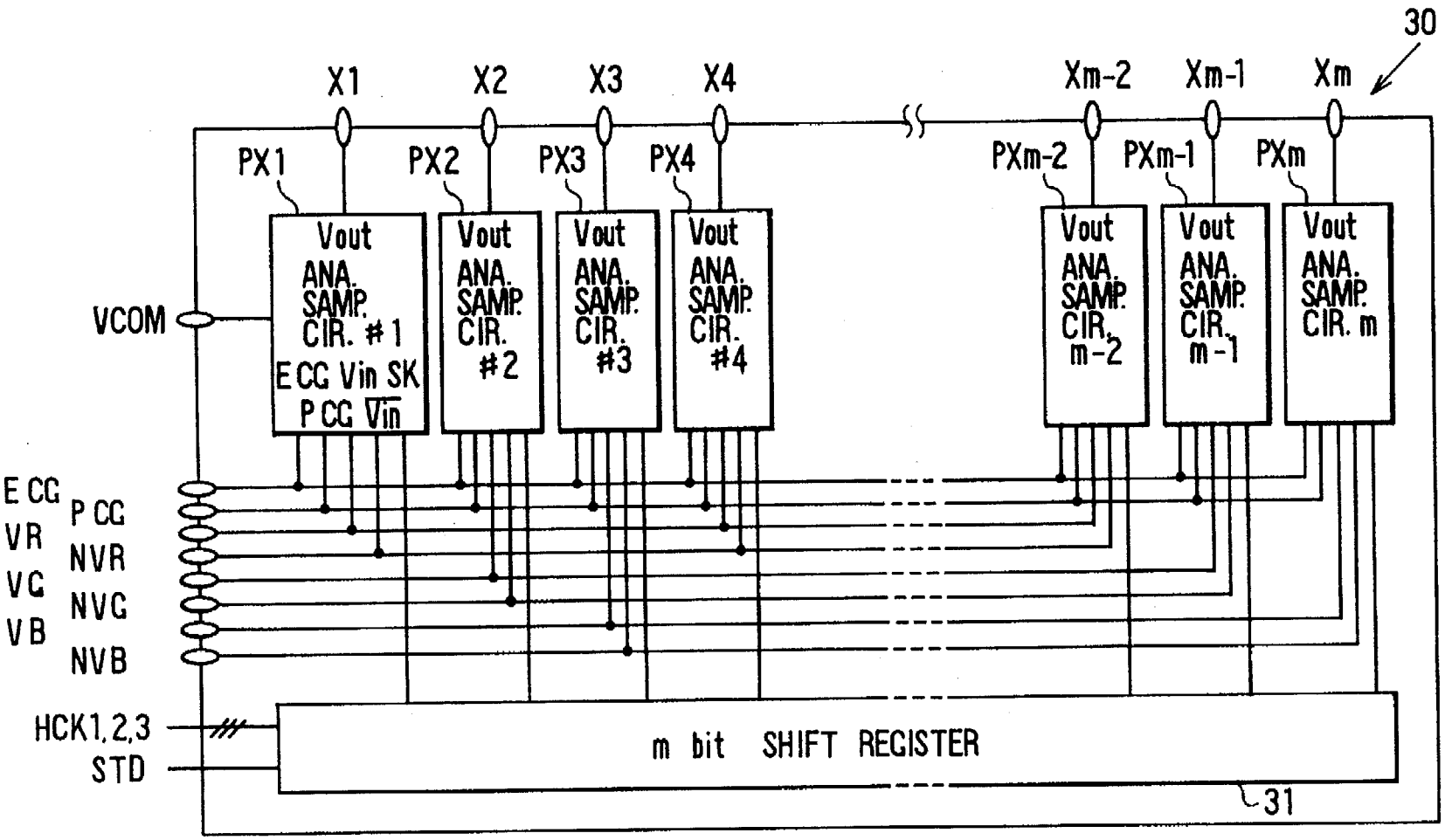
FIG. 4 is a block diagram of a signal electrode driver of the liquid crystal display device.

A signal electrode driver 30 is provided for applying signal voltages to the signal electrodes X1–Xm of the liquid crystal panel 10. FIG.4 shows a construction of the signal electrode driver 30. As shown in FIG. 4, the signal electrode driver 30 includes an m bit shift register 31 and analog sampling circuits PX1–PXm that are controlled by the shift register 31.

The m bit shift register 31 receives STD, HCK1, HCK2 and HCK3 signals from the controller 50. The STD signal sets the timing for providing the image signal voltage to the signal electrodes X1–Xm. The HCK1 signal is for setting the sampling timing of image signal voltages X1, X4, X7, . . . , Xm–2. The HCK2 signal is for setting the sampling timing of image signal voltages X2, X5, X8, . . . , Xm–2 while the HCK3 signal is for setting the sampling timing of image signal voltages X3, X6, X9, . . . , Xm.

Figures 5A, 5B, 5C, 5D, 5E, 5F, 5G, 5H, 5I, 5J, 5K, 5L, 5M, 5N:
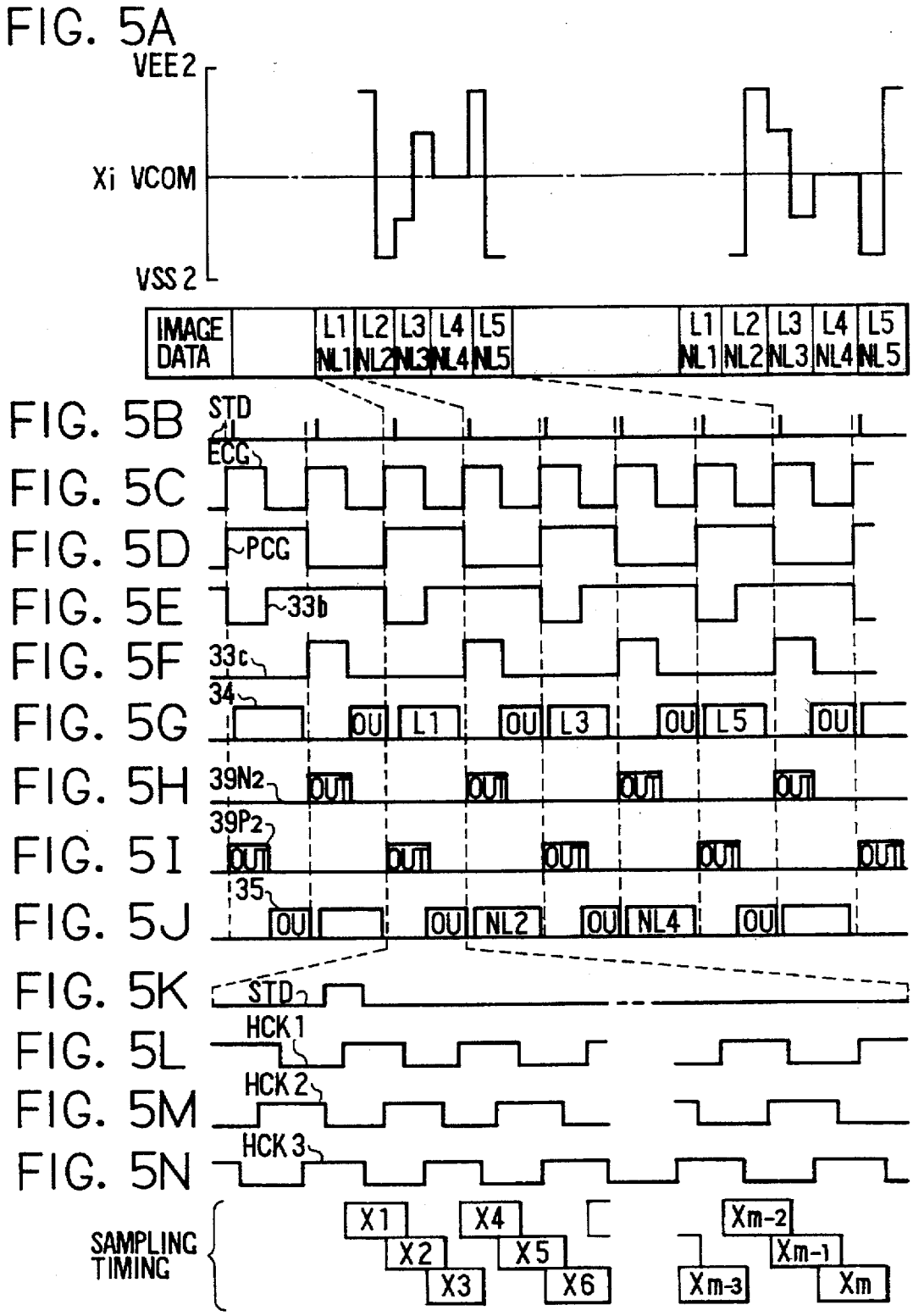
FIGS. 5A–5N are time charts showing an operation of the signal electrode driver.

The sampling timing is determined in the following manner. As shown in FIGS. 5A–5N, with the STD signal at a high level, the sampling timing of the image signal voltage of the signal electrode X1 is set to high starting from the rising edge of the HCK1 signal and stays at this level while the HCK1 signal is high. In the same way, when the HCK1 signal is at a high level, the sampling timing of the image signal voltage of the signal electrode X2 is set to high starting from the rising edge of the HCK2 signal and stays high while the HCK2 signal is high. Moreover, when the HCK2 signal is at a high level, the sampling timing of the image signal voltage of the signal electrode X3 is set to high starting from the rising edge of the HCK3 signal and stays at this level while the HCK3 signal is high. The sampling timings of the image signal voltages of subsequent signal electrodes X4, X5, . . . and Xm are also set to the high level in the same way.

Therefore, for each of the scanning electrodes Y1–Yn, the m-bit shift register 31 provides the sampling timing signals to each SK terminal of respective analog sampling circuits PX1–PXm based on the STD, HCK1, HCK2 and HCK3 signals.

Based on the sampling timing signals, image signals VR, NVR (described later) are provided to analog sampling circuits that correspond to signal electrodes X1, X4, X7, . . . , Xm–2, image signals VG, NVG (described later) are provided to analog sampling circuits that correspond to signal electrodes X2, X5, X8, . . . Xm–1 and image signals VB, NVB (described later) are provided to analog sampling circuits that correspond to signal electrodes X3, X6, X9, . . . Xm.

Figure 6:
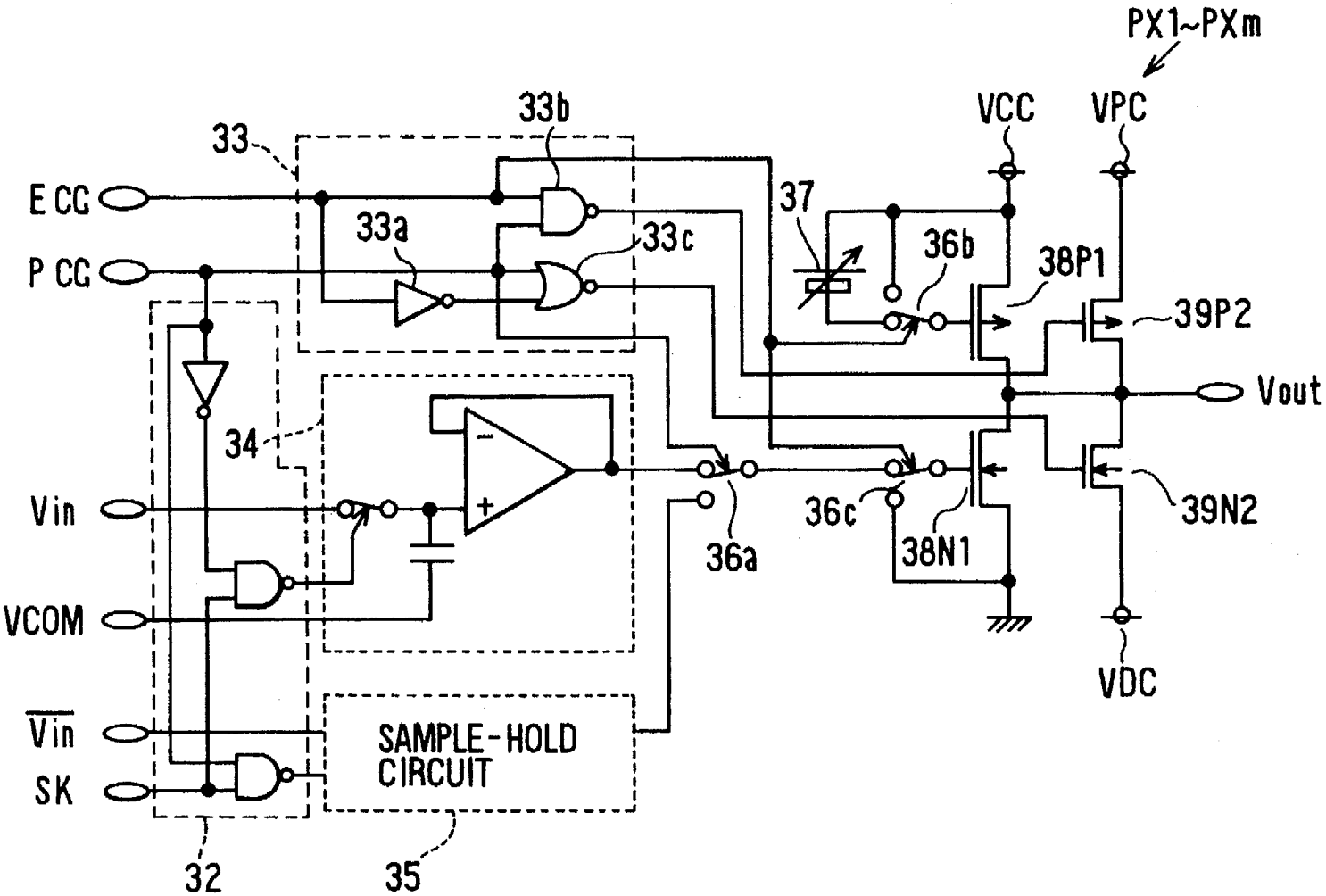
FIG. 6 is a circuit diagram of an analog sampling circuit of the signal electrode driver.

FIG. 6 shows the construction of these analog sampling circuits PX1–PXm. As shown in FIG. 6, each of the analog sampling circuits PX1–PXm include switching circuits 32, 33 and sample-and-hold circuits 34, 35. The sample-and-hold circuits 34, 35 include capacitors, analog switches and operational amplifiers.

Upon receipt of the SK signal from the shift register 31 and a PCG signal from the controller 50, the switching circuit 32, which includes NOT and NAND gates as shown in FIG. 6, controls analog switches that are inside the sample-and-hold circuits 34, 35. The relationship of the actuation/deactuation of these analog switches with the SK and PCG signals is easily understood by referring to FIGS. 5G and 5J which indicate the operations of both sample-and-hold circuits 34 and 35.

The switching circuit 33, which includes a NOT gate **33*a*, a NAND gate 33*b* and a NOR gate 33*c* that are connected as shown in FIG. 6, controls analog switches 36*a*–36*c* (described later) and FETs 39P2 and 39N2 based on ECG and PCG signals it receives from the controller 50**.

The sample-and-hold circuit 34 samples and maintains the positive image signal voltage Vin (which may be one of VR, VG and VB) while the sample-and-hold circuit 35 samples and maintains the negative image signal voltage Vin (which may be one of NVR, NVG and NVB). These sample-and-hold circuits 34, 35 operate in such a way that they can be alternately switched so that one circuit may be in a hold state for generating its held signal while the other circuit is sampling the image signal voltage for the next scanning line. This switching is performed using the switching circuit 32 based on the PCG signal (refer to FIGS. 5D and 6) provided by the controller 50.

In response to the sampling timing signal provided to its SK terminal, the switching circuit 32 provides a signal to the sample-and-hold circuit that is in a sampling state to sample the image signal voltage. The switching circuit 32 also provides a signal to the sample-and-hold circuit that is in the hold state to generate a positive or negative image signal voltage. Moreover, the analog switches **36*a*–36*c* and FETs 39P2 and 39N2 are controlled by the switching circuit 33** based on ECG and PCG signals.

The analog switch **36*a* is switched for each of the scanning lines based on the PCG signal. Here, when the PCG signal is high, the analog switch 36*a* passes the image signal voltage held by the sample-and-hold circuit 34 to the analog switch 36*c*. On the other hand, when the PCG signal is low, the analog switch 36b passes the image signal voltage held by the sample-and-hold circuit 35 to the analog switch 36c**.

When the ECG signal is high, FETs 38P1 and 38N1 are deactuated by analog switches 36b and 36c. On the other hand, when the ECG signal is low, FETs 38P1 and 38N1 are actuated by the bias voltage of a direct current source 37 with the actuation of analog switches 36b and 36c.

FETs 39P2 and 39N2 are controlled by the switching circuit 33 based on PCG and ECG signals. Here, when the output of the NAND gate 33b is low, FET 39P2 is actuated. On the other hand, when the output of the NAND gate 33b is high, FET 39P2 is deactuated. Meanwhile, FET 39N2 actuates when the output of the NOR gate 33c is high. On the other hand, FET 39N2 deactuates when the output of the NOR gate 33c is low.

Figure 7:
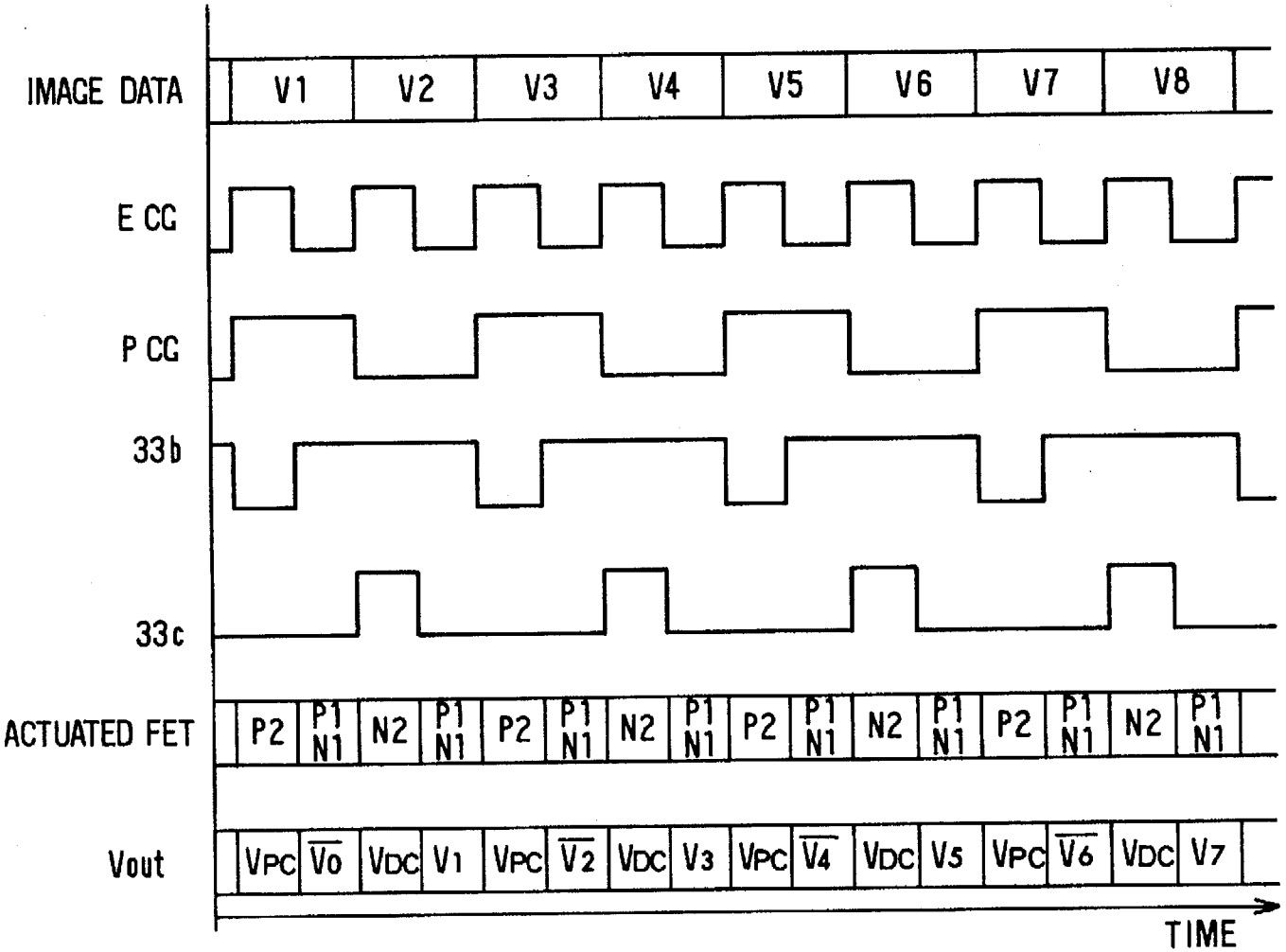
FIG. 7 is a time chart showing an operation of the analog sampling circuit.

In this way, FETs 38P1, 38N1, 39P2 and 39N2 are actuated and deactuated as shown by the time chart of FIG. 7. FET 39P2 generates a direct current voltage VDC (which corresponds to VS of FIG. 10B) when actuated while FET 39N2 generates voltage VDC (which corresponds to −VS of FIG. 10B). On the other hand, FETs 38P1 and 38N1 generate the image switch signal voltage from the analog switch 36b when they are both actuated.

The above-described operations are performed by each of the analog sampling circuits PX1–PXm which provide the image signal voltages to the signal electrodes X1–Xm.

With the set of image data for all pixels provided along the jth scanning electrode based on the positive image signal voltages VR, VG and VB set as Lj and the set of image data for all pixels provided along the jth scanning electrode based on the negative image signal voltages NVR, NVG, NVB set as NLj, FIG. 5A shows the timing for generating the image signal voltages that are sampled by the sample-and-hold circuits 34, 35 starting from L1, NL1.

Figure 8:
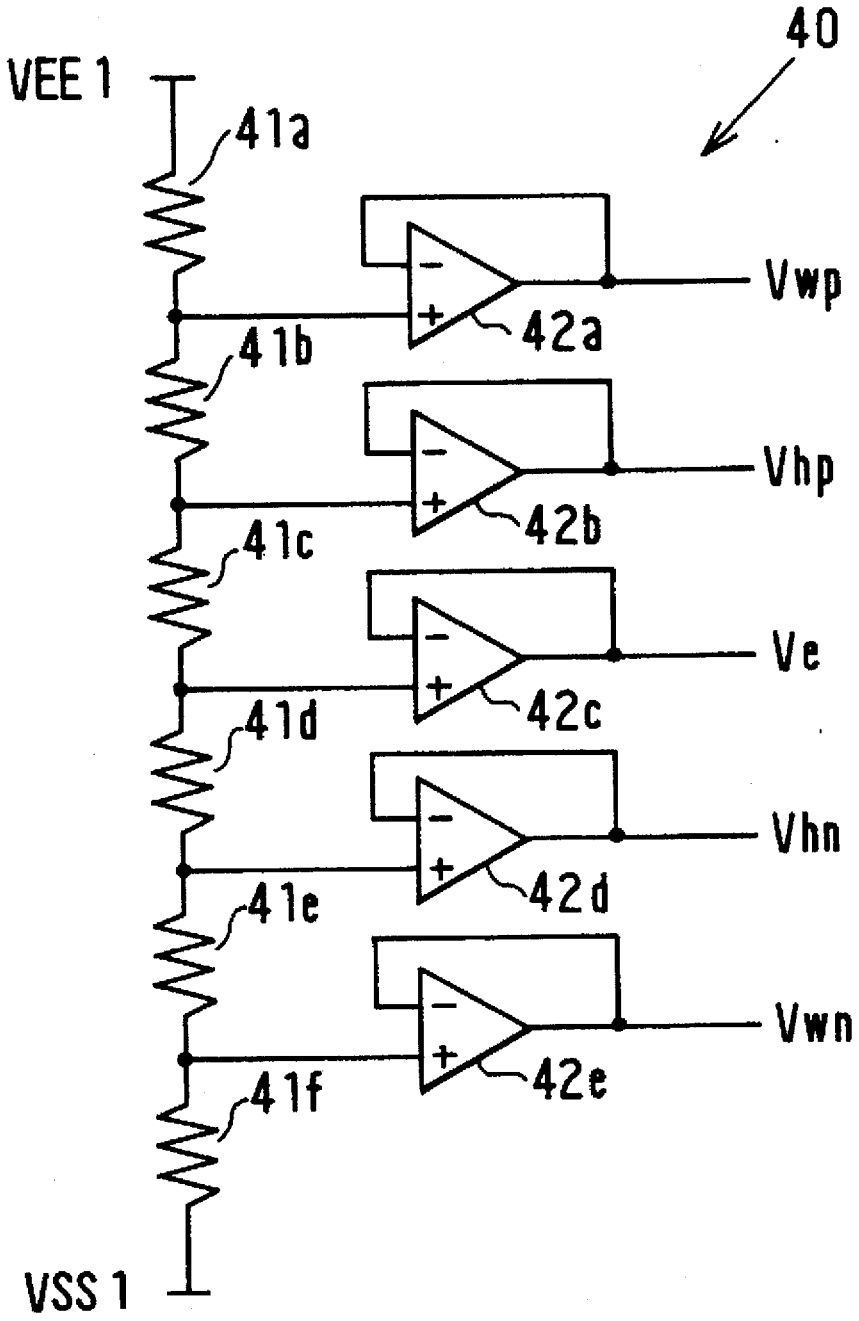
FIG. 8 is a circuit diagram of a driving voltage generator of the liquid crystal display device.

FIG. 8 shows a driving voltage generator 40 which generates five types of voltages (Vwp, Vhp, Ve, vhn, Vwn) from buffer amplifiers 42a–42e by dividing a voltage supplied by a power source 70 using resistors 41a–41f. Among the five levels of voltage generated by the driving voltage generator 40, Ve is a voltage level which represents the median of the remaining four voltages.

Figure 9:
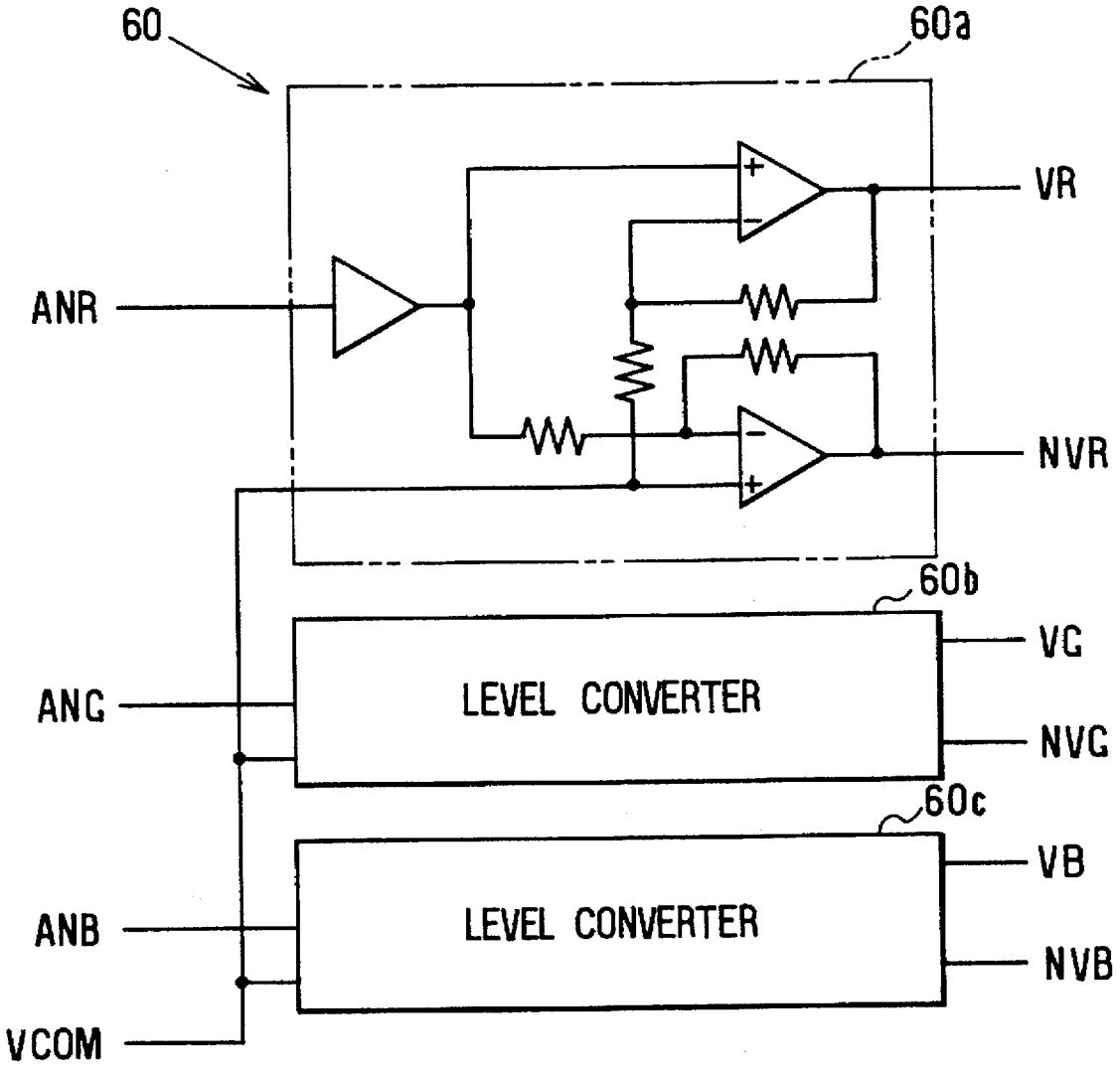
FIG. 9 is a circuit diagram of a level converter unit of the liquid crystal display device.

As shown in FIG. 9, with the reference voltage VCOM (common voltage) serving as the reference voltage level, the level converter 60 uses non-inverting and inverting amplifiers in converters 60a–60c to produce positive image signal voltages VR, VG, VB and negative image signal voltages NVR, NVG, NVB (N indicates an opposite polarity) which are A and −A multiples, respectively, of externally supplied image data signals ANR, ANG and ANB (analog R, G, B signals).

Figure 10A:
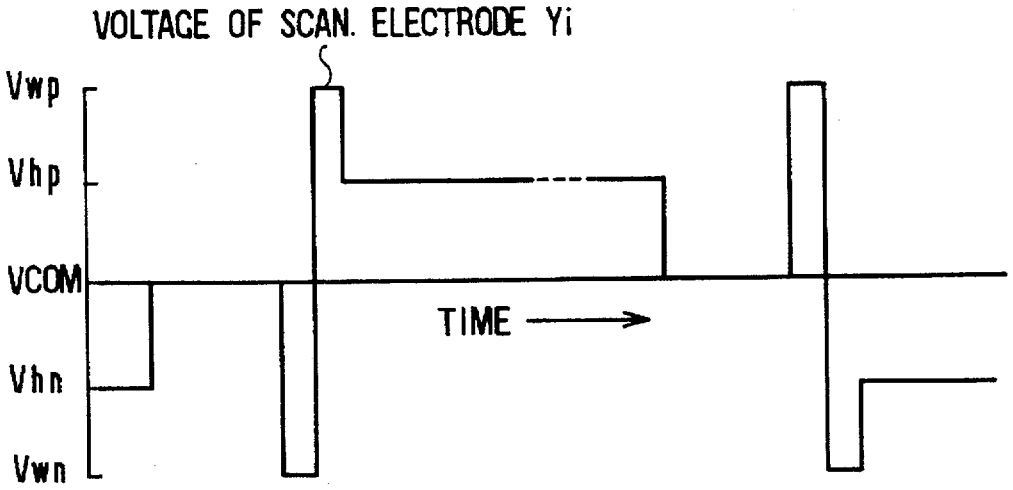
FIGS. 10A–10C are graphs showing waveforms of scanning voltages generated by the scanning electrode driver, image signal voltages generated by the signal electrode driver and the combination of these voltages according to the first embodiment.
Figure 10B:
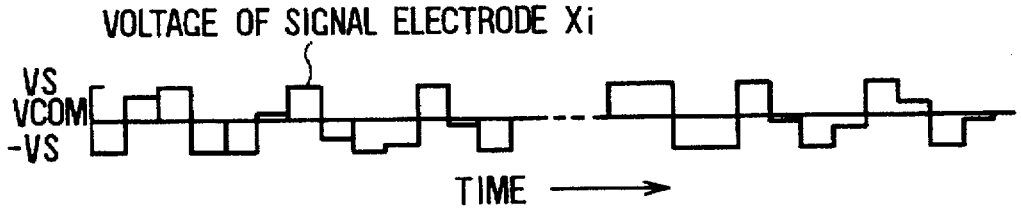
Figure 10C:
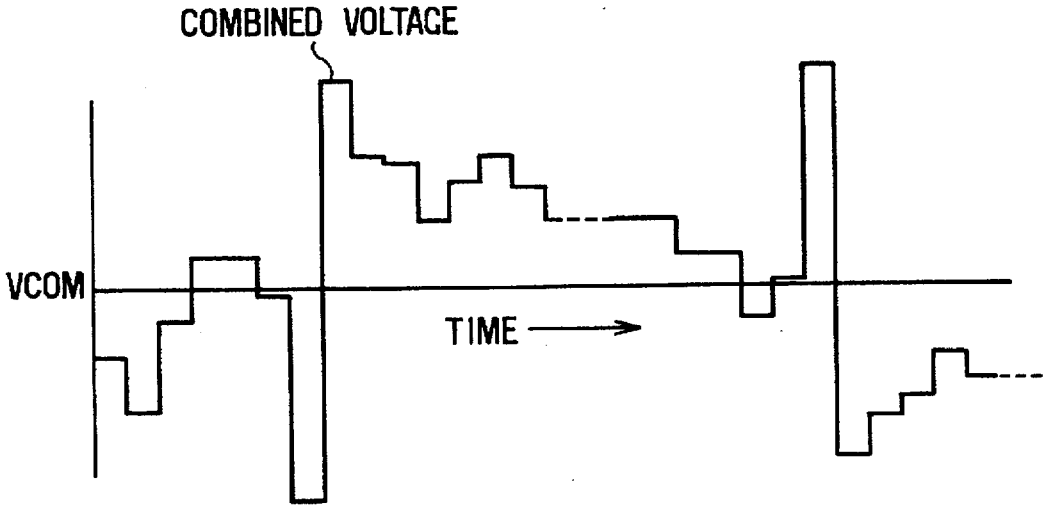

The liquid crystal display device of the present invention synchronizes the ECG and PCG signals and provides the image data to the pixels arranged along the scanning electrode one select period prior to the actual select period of the scanning electrode to produce the image signal data shown in FIG. 10B.

In this case, during the first half of the select period of a scanning electrode, each of the analog sampling circuits PX1–PXm generates one of direct current voltages VPC, VDC with the actuation of one of FETs 39P2 and 39N2 while serially connected FETs 38P1 and 38N1 are in a deactuated state. Furthermore, with the actuation of FETs 38P1, 38N1 during the latter half of the select period, each of the analog sampling circuits PX1–PXm generates the image signal voltage.

Accordingly, with FETs 38P1 and 38N1 being actuated only during half of the select period of the scanning electrode, the amount of current passing through FETs 38P1, 38N1 during the select period will be half that of the conventional devices in which current passes through FETs 38P1, 38N1 during the entire select period.

Thus, power consumption of analog sampling circuits PX1–PXm is reduced to half. In this way, the signal electrode driver 30 can be formed as an IC chip with no heat being produced in the IC chip that will cause display blots in the liquid crystal panel 10.

In addition, the light transmissivity of the display of the liquid crystal display device depends on the magnitude of the image signal voltage applied during the latter half of the select period with the signal applied during the first half being used for charging the pixels. Therefore, the voltage applied during the first half of the select period will have virtually no effect on the brightness of the display of the display device if it is at least no less than a predetermined value. Here, the signal voltage applied to the signal during the first half of the select period is one of voltages VPC and VDC. These voltages VPC, VDC (which are set to VS, −VS respectively in the foregoing embodiment) have magnitudes which are sufficient for lightening the pixels and which are preferably set to a voltage for obtaining the maximum light transmissivity from the pixels. In this way, the light transmissivity of the display of the display device according to the present invention is the same as that of conventional devices.

Also, the polarity of the direct current components of the voltage applied to the anti-ferroelectric liquid crystal display is inverted so that the amount of direct current is reduced to a level that will not adversely affect the display panel 10. That is, direct current components can be eliminated because both signal voltages VPC and VDC, which have opposite polarities and which are applied during the first half of the select period, have the same magnitude.

In addition, in the foregoing embodiment, positive image signal voltages VR, VB and VG, and respective negative signal voltages NVR, NVB and NVG, which are output voltages of the level converter 60, are symmetrical with respect to the output voltage Ve, i.e., reference voltage VCOM, of the driving voltage generator 40. Moreover, because sample-and-hold circuits 34 and 35 receive reference voltage VCOM, these sample-and-hold circuits 34 and 35 sample incoming image signal voltages with VCOM serving as the reference. Therefore, even if output voltages VEE1, VSS1 of the power source circuit 70 and output voltages VSS2, VEE2 of the power source circuit 80 fluctuate, image signal voltages are generated with reference to the reference voltage VCOM and thus, there is no relative fluctuation in the driving voltages of the display panel 10 and the application of direct current that causes damage to the display panel 10 is prevented.

Figure 11A:
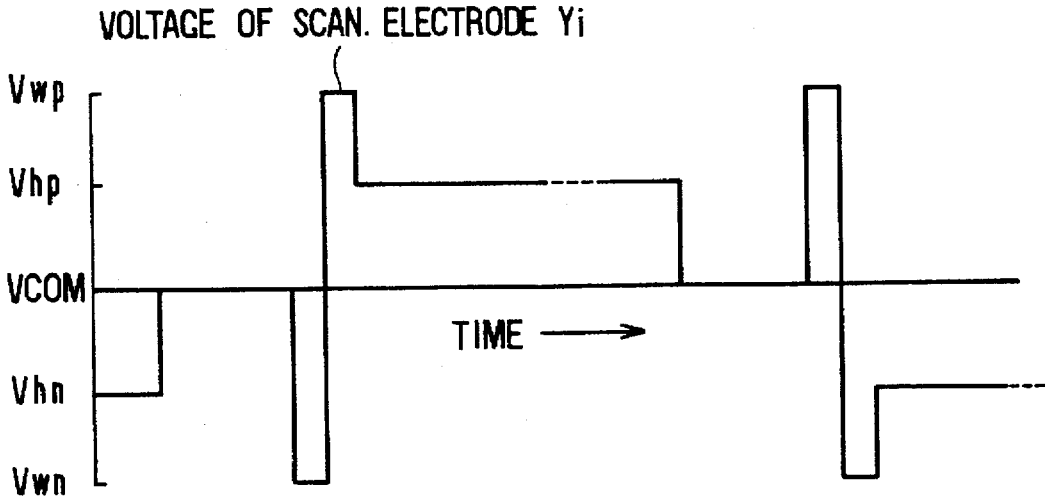
FIGS. 11A–11C are graphs showing waveforms of scanning voltages generated by the scanning electrode driver, image signal voltages generated by the signal electrode driver and the combination of these voltages according to a second embodiment of the present invention.
Figure 11B:
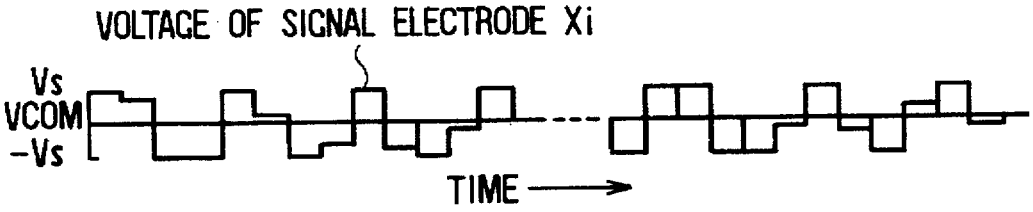
Figure 11C:
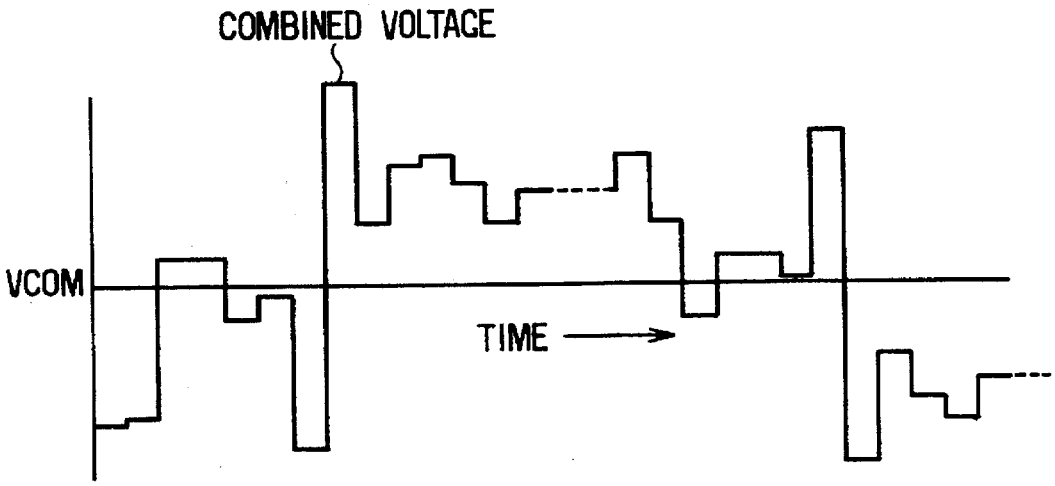
Figure 12:
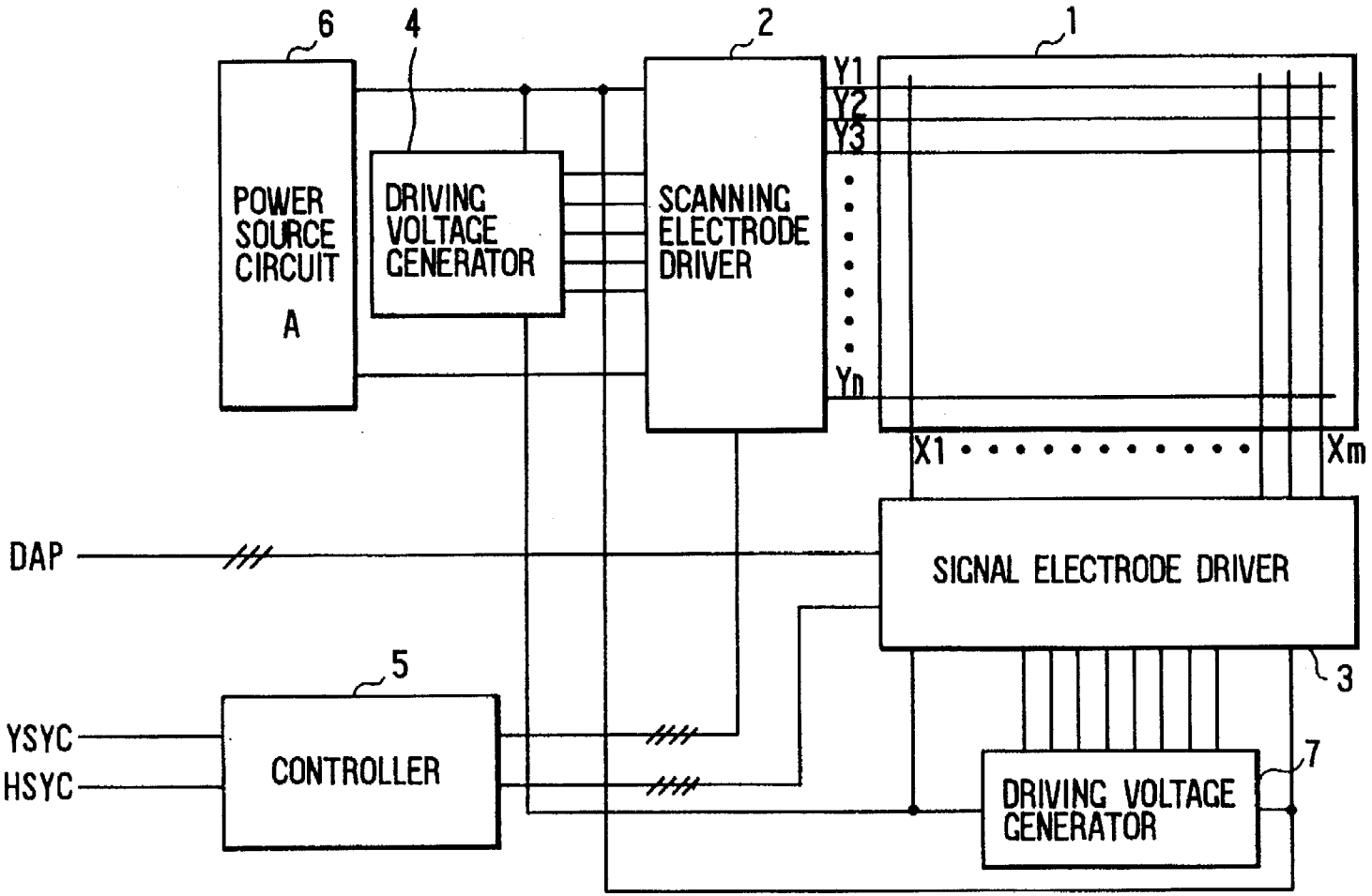
FIG. 12 PRIOR ART
FIG. 12 is a block diagram of a conventional liquid crystal display device.
Figure 13A:
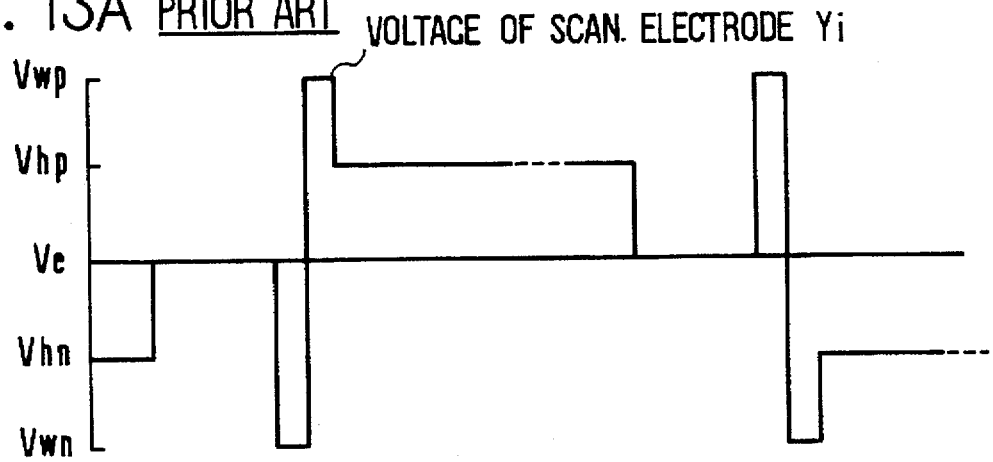
FIG. 13A PRIOR ART
FIGS. 13A–13D are graphs showing waveforms of scanning voltages generated to scanning electrodes, image signal voltages generated to a signal electrode and the combination of these voltages for the conventional display device.
Figure 13B:
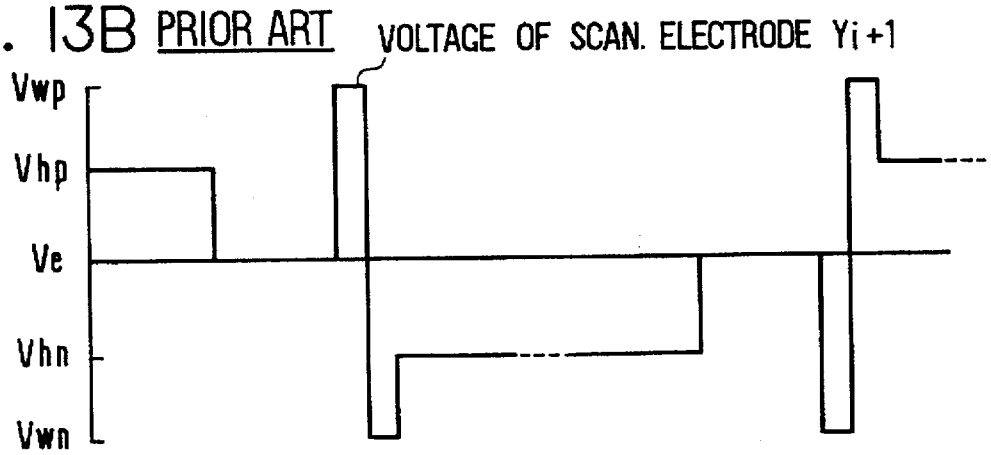
FIG. 13B PRIOR ART
Figure 13C:
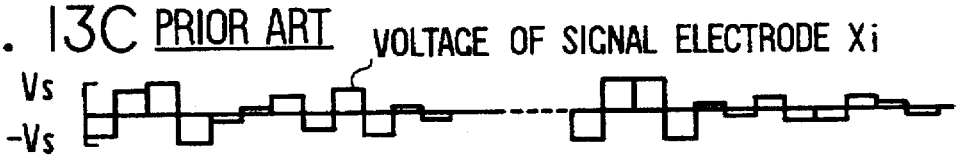
FIG. 13C PRIOR ART
Figure 13D:
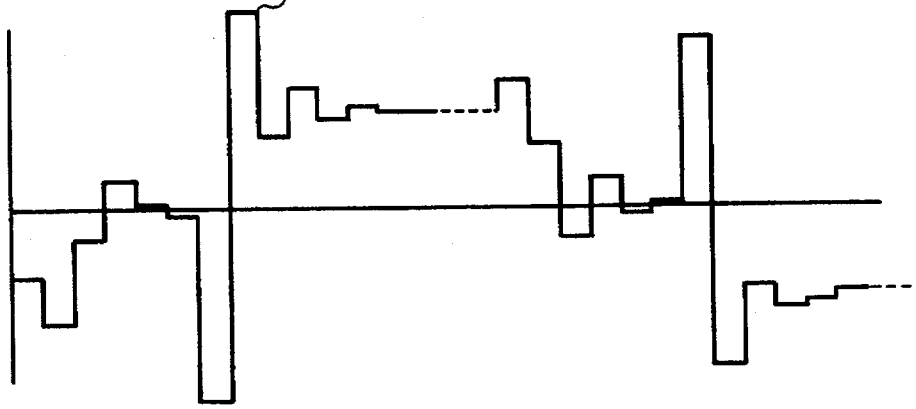
FIG. 13D PRIOR ART
Figure 14:
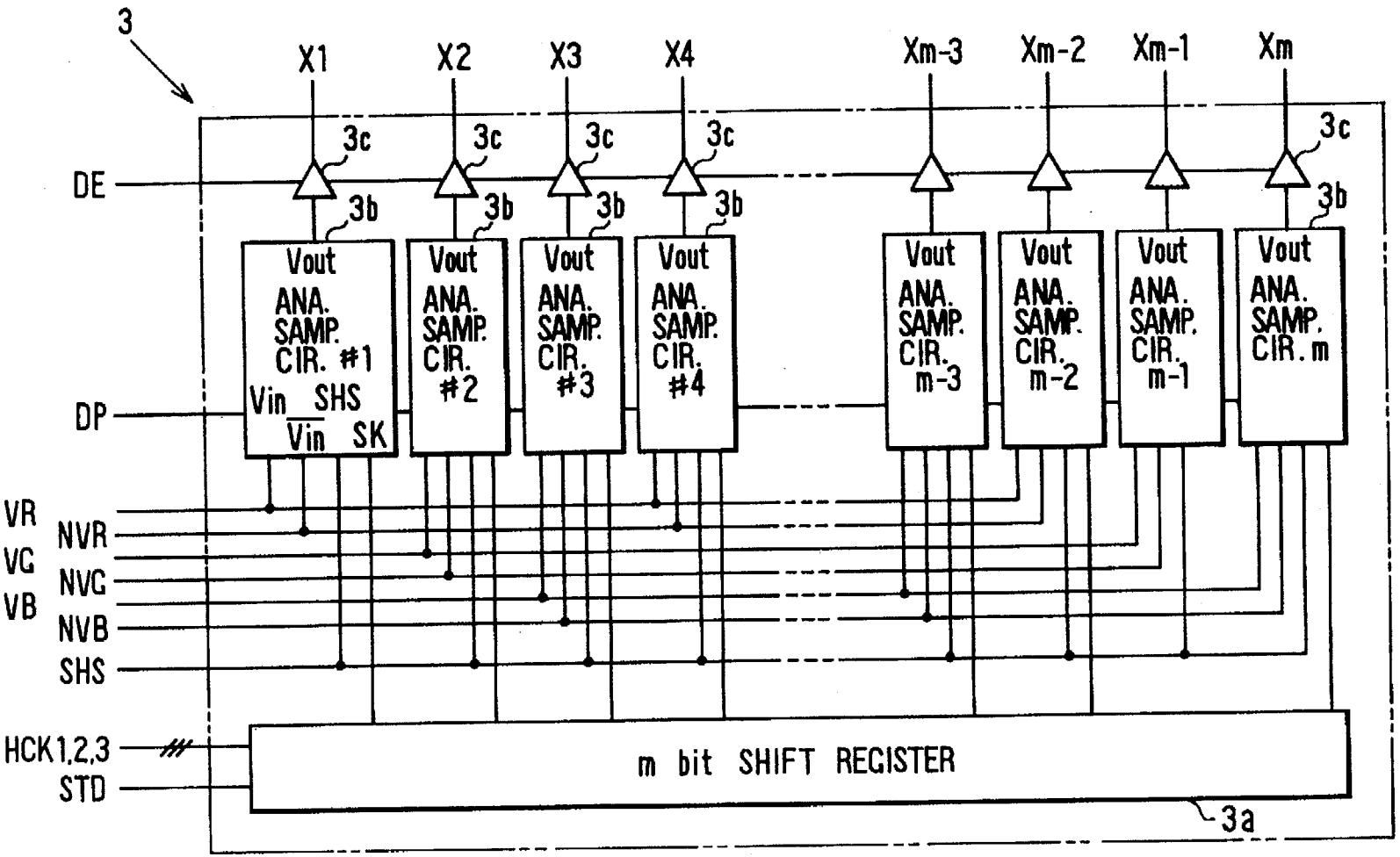
FIG. 14 PRIOR ART
FIG. 14 is a circuit diagram of the signal electrode driver of the conventional display device.
Figure 15:
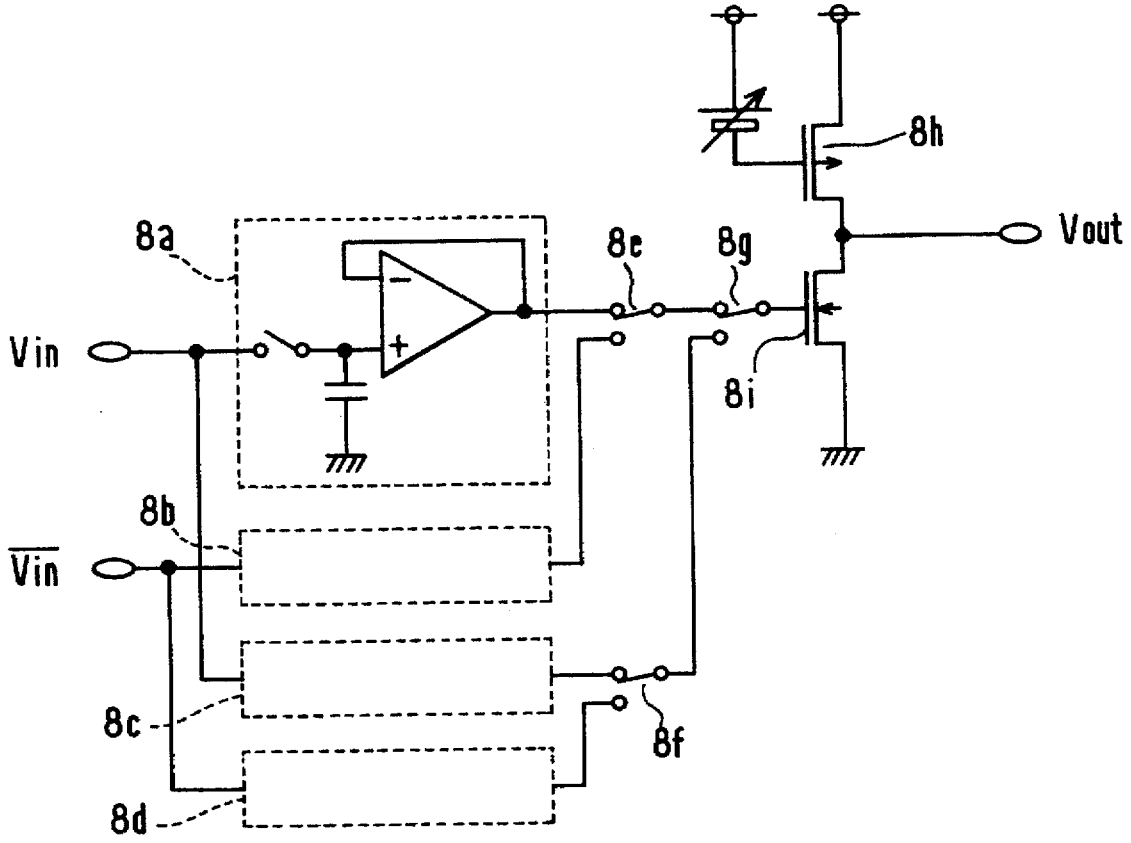
FIG. 15 PRIOR ART
FIG. 15 is a circuit diagram of the analog sampling circuit of the conventional display device.

FIGS. 11A–11C shows image signal voltages and scanning voltages generated by the liquid crystal display device according to a second embodiment of the present invention. In this second embodiment, the order for providing voltages VPC and VDC during the first half of the select period are reversed compared with that of the first embodiment and in doing so, the same effects as that of the first embodiment can also be obtained.

Although the present invention has been fully described in connection with preferred embodiments thereof with reference to the accompanying drawings, it is to be noted that various changes and modifications will become apparent to those skilled in the art.

For example, while the anti-ferroelectric type liquid crystal medium is used here, the present invention may also be applied to a smectic ferroelectric liquid crystal display device. Also, while the output voltages of FETs 39P2 and 39N2 of analog sampling circuits PX1–PXm have been set to VPC and VDC, the output voltages may be set to arbitrary values that are between VS and –VS. Moreover, other types of transistors may be used in place of FETs 38P1, 38N1, 39P2 and 39N2.

Such changes and modifications are to be understood as being within the scope of the present invention as defined by the appended claims.

What is claimed is:

1. A matrix type liquid crystal display device comprising:

a liquid crystal panel having a plurality of scanning electrodes, a plurality of signal electrodes and a liquid crystal layer, said plurality of scanning electrodes and said plurality of signal electrodes cooperating with said liquid crystal layer to form a plurality of pixels for displaying an image;

scanning electrode driving means for sequentially scanning said plurality of scanning electrodes of said liquid crystal panel by applying a select voltage to each scanning electrode of said plurality of scanning electrodes during a select period for lightening pixels along each respective scanning electrode; and signal electrode driving means for applying a signal voltage to said plurality of signal electrodes of said liquid crystal panel, said signal electrode driving means including:

predetermined voltage generation means for generating a predetermined voltage;

image signal generation means for generating a display voltage in accordance with said image to be displayed in said liquid crystal panel; and setting means for setting said predetermined voltage as said signal voltage during a first half of said select period, for setting said display voltage as said signal voltage during a latter half of said select period and for deactuating said image signal generation means during said first half of said select period.

2. A matrix type liquid crystal display device according to claim 1, wherein:

said predetermined voltage generation means of said signal electrode driving means includes first fixed voltage generation means for generating a first fixed voltage, second fixed voltage generation means for generating a second fixed voltage, said second fixed voltage having a magnitude equal to that of said first fixed voltage generated by said first fixed voltage generation means, said second fixed voltage having a polarity opposite that of said first fixed voltage, and fixed voltage selection means for alternately setting said predetermined voltage to be one of said first fixed voltage and said second fixed voltage; and said image signal generation means of said signal electrode driving means includes display signal generation means for generating an image voltage in accordance with said image to be displayed in said display panel, and display signal selection means for alternately setting said display voltage to be one of said image voltage and a negative value of said image voltage.

3. A matrix type liquid crystal display device according to claim 2, wherein:

said first fixed voltage generation means includes a first fixed voltage transistor;

said second fixed voltage generation means includes a second fixed voltage transistor connected in series with said first fixed voltage transistor of said first fixed voltage generation means;

said fixed voltage selection means is a logic circuit that is connected to both said first fixed voltage transistor of said first fixed voltage generation means and said second fixed voltage transistor of said second fixed voltage generation means to selectively actuate and deactuate said first fixed voltage transistor and said second fixed voltage transistor to alternately set said predetermined voltage to be one of said first fixed voltage and said second fixed voltage;

said display signal generation means includes a first display voltage transistor and a second display voltage transistor which is connected in series with said first display voltage transistor; and said display signal selection means is a switching means for controlling actuation and deactuation of said first display voltage transistor and said second display voltage transistor to produce said display voltage.

4. A matrix type liquid crystal display device according to claim 3, wherein:

said first fixed voltage transistor of said first fixed voltage generation means is a P-channel FET;

said second fixed voltage transistor of said second fixed voltage generation means is an N-channel FET;

said first display voltage transistor of said display voltage generation means is a P-channel FET; and said second display voltage transistor of said display voltage generation means is an N-channel FET.

5. A matrix type liquid crystal panel according to claim 4, wherein:

said liquid crystal layer is an anti-ferroelectric liquid crystal layer; and said predetermined voltage generated by said predetermined voltage generation means is a voltage for obtaining a maximum light transmissivity from said pixels.

6. A matrix type liquid crystal panel according to claim 3, wherein:

said liquid crystal layer is an anti-ferroelectric liquid crystal layer; and said predetermined voltage generated by said predetermined voltage generation means is a voltage for obtaining a maximum transmissivity from said pixels.

7. A matrix type liquid crystal panel according to claim 1, wherein:

said liquid crystal layer is an anti-ferroelectric liquid crystal layer; and said predetermined voltage generated by said predetermined voltage generation means is a voltage for obtaining a maximum transmissivity from said pixels.

8. A driver for driving a liquid crystal panel of a matrix type liquid crystal display device to display an image in said liquid crystal panel, said driver comprising:

a scanning electrode driving unit which is for sequentially scanning a plurality of scanning electrodes of a liquid crystal panel of a matrix type liquid crystal device by applying a scanning voltage to each scanning electrode of said plurality of scanning electrodes during a select period; and a signal electrode driving unit which is for applying a signal voltage to a plurality of signal electrodes of said liquid crystal panel, said signal electrode driving unit including:

a predetermined voltage generator which is for generating a predetermined voltage;

an image signal generator which is for generating a display voltage in accordance with an image to be displayed in said liquid crystal panel; and setting means for setting said predetermined voltage as said signal voltage during a first half of said select period, for setting said display voltage as said signal voltage during a latter half of said select period and for deactuating said image signal generator during said first half of said select period.

9. A driver for driving a liquid crystal panel according to claim 8, wherein:

said predetermined voltage generator of said signal electrode driving unit includes a first fixed voltage generator which is for generating a first fixed voltage, a second fixed voltage generator which is for generating a second fixed voltage, said second fixed voltage having a magnitude equal to that of said first fixed voltage generated by said first fixed voltage generator, said second fixed voltage having a polarity opposite that of said first fixed voltage, and fixed voltage selection means for alternately setting said predetermined voltage to be one of said first fixed voltage and said second fixed voltage; and said image signal generator of said signal electrode driving unit includes a display signal generator which is for generating an image voltage in accordance with said image to be displayed in said display panel, and display signal selection means for alternately setting said display voltage to be one of said image voltage and a negative value of said image voltage.

10. A driver for driving a liquid crystal panel according to claim 9, wherein:

said first fixed voltage generator includes a first fixed voltage transistor;

said second fixed voltage generator includes a second fixed voltage transistor connected in series with said first fixed voltage transistor of said first fixed voltage generator;

said fixed voltage selection means is a logic circuit that is connected to both said first fixed voltage transistor of said first fixed voltage generator and said second fixed voltage transistor of said second fixed voltage generator to selectively actuate and deactuate said first fixed voltage transistor and said second fixed voltage transistor to alternately set said predetermined voltage to be one of said first fixed voltage and said second fixed voltage;

said display signal generator includes a first display voltage transistor and a second display voltage transistor which is connected in series with said first display voltage transistor; and said display signal selection means is a switching means for controlling actuation and deactuation of said first display voltage transistor and said second display voltage transistor to produce said display voltage.

11. A driver for driving a liquid crystal panel according to claim 10, wherein:

said first fixed voltage transistor of said first fixed voltage generator is a P-channel FET;

said second fixed voltage transistor of said second fixed voltage generator is an N-channel FET;

said first display voltage transistor of said display voltage generator is a P-channel FET; and said second display voltage transistor of said display voltage generator is an N-channel FET.

12. A driver for driving a liquid crystal panel according to claim 11, wherein said predetermined voltage generated by said predetermined voltage generator is a voltage for obtaining a maximum transmissivity from said liquid crystal panel.

13. A driver for driving a liquid crystal panel according to claim 10, wherein said predetermined voltage generated by said predetermined voltage generator is a voltage for obtaining a maximum transmissivity from said liquid crystal panel.

14. A driver for driving a liquid crystal panel according to claim 9, wherein said predetermined voltage generated by said predetermined voltage generator is a voltage for obtaining a maximum transmissivity from said liquid crystal panel.

15. A driver for driving a liquid crystal panel according to claim 8, wherein said predetermined voltage generated by said predetermined voltage generator is a voltage for obtaining a maximum transmissivity from said liquid crystal panel.

* * * * *